United States Patent [19]

McLaughlin et al.

[11] Patent Number: 4,979,613

[45] Date of Patent: Dec. 25, 1990

[54] SEPARABLE FASTENING DEVICE

[75] Inventors: Carol A. McLaughlin, Cincinnati; Randy J. Kleinsmith, Fairfield, both of Ohio

[73] Assignee: The Proctor & Gamble Company, Cincinnati, Ohio

[21] Appl. No.: 458,101

[22] Filed: Dec. 28, 1989

[51] Int. Cl.[5] ..... B65D 69/00

[52] U.S. Cl. ..... 206/233; 206/812; 206/813; 224/901; 24/304; 24/442

[58] Field of Search ..... 206/205, 233, 632, 812, 206/813; 383/90; 40/594; 24/442–446, 304; 224/901

[56] References Cited

U.S. PATENT DOCUMENTS

| | | | |
|---|---|---|---|
| 2,717,437 | 9/1955 | de Mestral . | |
| 3,009,235 | 11/1961 | de Mestral . | |
| 4,071,186 | 1/1978 | Ruda | 206/632 |
| 4,119,249 | 10/1978 | Hanson | 224/901 |
| 4,131,195 | 12/1978 | Worrell, Sr. | 206/812 |
| 4,192,420 | 3/1980 | Worrell, Sr. et al. | 206/812 |
| 4,473,153 | 9/1984 | Colangelo | 206/813 |
| 4,559,705 | 12/1985 | Hodge et al. . | |
| 4,652,239 | 3/1987 | Briberg | 40/594 |
| 4,684,264 | 8/1987 | Paperno et al. . | |
| 4,741,119 | 5/1988 | Baryla | 40/594 |

OTHER PUBLICATIONS

Pied Piper "The Gifted Childrens' Catalog", Item B on p. 42, Colorforms.

*Primary Examiner*—David T. Fidei

*Attorney, Agent, or Firm*—Jeffrey V. Bamber; Larry L. Huston; Fredrick H. Braun

[57] ABSTRACT

A separable fastening device is provided for releasably fastening a first surface to a second surface. The separable fastening device comprises a first fastening element of high static vinyl material which is attached to the first surface, and a second fastening element of high static vinyl attached to the second surface. When the first fastening element and the second fastening element are placed against each other in a face-to-face relationship, the attractive forces between the first and second fastening elements form a separable bond between the first and second surfaces.

3 Claims, 3 Drawing Sheets

SEPARABLE FASTENING DEVICE

FIELD OF THE INVENTION

The present invention generally relates to separable fastening devices and methods of making the same. The present invention also relates to methods of releasably fastening articles. More particularly, this invention is concerned with such devices and methods which utilize components comprised of high static vinyl material.

BACKGROUND OF THE INVENTION

Separable fastening devices are currently used widely in a great number of applications. Articles which are repeatedly opened and closed are examples of situations in which it is desirable to employ separable, or releasable, fastening devices. Certain packages, for instance, require a closure which permits periodic access to the package contents and will be held closed during the remaining periods. Other uses of separable fastening devices include those uses which are incorporated into clothing, disposable articles, and various miscellaneous articles such as safety belts and the like in which it is desirable to create a releasable bond between two or more articles or between several surfaces of the same article. In certain applications, these prior separable fastening devices have replaced conventional buckles, zippers, buttons, snaps, tie fasteners, and sewing.

Virtually all of the prior separable fastening systems can generally be categorized as either mechanical fastening systems or adhesive fastening systems. Mechanical fastening systems, or mechanical fasteners, are those in which a releasable mechanical bond is formed between the components of the fastening system. Adhesive fasteners utilize the adhesive properties, or the tackiness of the surfaces of one or more of their components to adhere to another surface to create a releasable bond. Despite the relatively wide acceptance of the two types of separable fastening devices, as discussed below, both types suffer from a number of drawbacks.

In most of the separable mechanical fastening systems currently in use, the mechanical bond formed between the components of the device is achieved by some type of entanglement between the component parts of the system. A popular type of mechanical fastener currently in wide use which utilizes mechanical entanglement to create a separable bond is sold under the trademark "VELCRO". VELCRO fastening devices are described in greater detail in U.S. Pat. No. 2,717,437 and U.S. Pat. No. 3,009,235 issued to George de Mestral. Briefly, VELCRO fasteners utilize two components, a male component and a female component. The male and female components are often referred to as the hook and loop components, respectively. The hook component consists of a fabric which contains a plurality of resilient, upstanding hook-shaped elements. The other component or part of the fastening system consists of a fabric which contains a plurality of upstanding loops on its surface. When the hook component and the loop component are pressed together in a face-to-face relationship to close the fastening system, the hooks entangle the loops to form a plurality of mechanical bonds between the individual hooks and loops. When the two components are pressed together to create these mechanical bonds, the components will not generally disengage under normal conditions. Should it be necessary to open this hook and loop type fastening system, it is very difficult to separate the components by attempting to disengage all of the hooks at once. However, when a gradual peeling force is applied to the hook component, disengagement can be easily effected since the hooks, which are comprised of a resilient material, will readily open when subjected to peeling forces.

Despite adequately serving their purpose of providing a generally reliable separable mechanical bond, the VELCRO-type mechanical fastening systems suffer from a number of drawbacks. When the male and female components of the commercially available version of the VELCRO fastening system are peeled apart, the disengagement of the hook and loop components creates a rather loud, harsh ripping noise. This is particularly undesirable in the case of one of the uses contemplated by the present invention where is is desirable to provide a separable fastening device for use in personal care situations, as in for instance, use in a personal package of facial tissues. Also, due to the fact that it is necessary to form the minute hook and loop elements, mechanical fastening devices, such as VELCRO, are relatively expensive to manufacture. This later disadvantage makes them generally undesirable for use as fasteners in disposable articles, that is, articles which are generally discarded after a single use.

The majority of adhesive separable fastening devices have been in use for a considerable period of time and have not changed significantly, as a result, most can be categorized in generic terms. An example of such a separable adhesive fastening device is one which employs a pressure sensitive adhesive material as one of its components. The primary disadvantage of pressure sensitive materials, and other devices which employ the conventional tacky or sticky surfaces to create a separable bond between two articles is that such surfaces are prone to contamination by, among other things, dirt, lint, dust, and the like, all of which tend to reduce the adhesive properties of the fastener. Eventually this loss of the adhesiveness will result in the rendering of the fastener completely useless for its intended purpose.

As a result of the foregoing, a need exists for an improved separable fastening system which overcomes the drawbacks inherent in the separable fastening devices currently in use.

Therefore, it is an object of the present invention to provide a separable fastening device which is capable of opening and closing more quietly than previously used mechanical fastening devices.

It is another object of the present invention to provide a separable fastening device which does not employ conventional adhesive surfaces which are subject to contamination and consequent loss of their adhesive properties.

It is also an object of the present invention to provide a separable fastening system which is inexpensive and simple to manufacture.

These and other objects of the present invention will be more readily apparent when considered in reference to the following description and when taken in conjunction with the accompanying drawings.

SUMMARY OF THE INVENTION

In accordance with the present invention, a separable fastening device for releasably fastening together two surfaces is provided. The surfaces to be fastened are referred to as the first and second surfaces, respectively. In the present invention, a first fastening element of high static vinyl material is attached to the first surface, and a second fastening element of high static vinyl material is attached to the second surface. When the first fastening element and the second fastening element are placed against each other in a face-to-face relationship, the attractive forces present between the first fastening element of high static vinyl material and the second fastening element of high static vinyl material form a separable bond between the two surfaces. Also described herein is a method of making such a separable fastening device, and a method of releasably fastening articles.

In its preferred form, the separable fastening device of the present invention is used for releasably fastening a closure flap on a personal package of facial tissues to the body of the package of tissues in order to keep the tissues inside clean while they are carried about. In this preferred use, a first fastening element of high static vinyl material is attached to the body of the package of tissues, and a second fastening element of high static vinyl material is attached to the closure flap of the package so that when the flap is closed, the first fastening element and the second fastening element are placed against each other in a face-to-face relationship and the attractive forces present between the first fastening element and the second fastening element form a separable bond between the closure flap of the package of tissues and the body of the package of tissues.

In the present invention, the first and second fastening elements are preferably each in the form of a strip of high static vinyl sheet material. The two strips of high static vinyl sheet material form a bond which does not involve any type of mechanical entanglement. As a result, when the two strips of high static vinyl sheet material are pulled apart to separate the two surfaces, no noticeable noise is created. Further, since it is not necessary to manufacture the intricate hook and loop components of prior mechanical-type separable fastening devices, the cost of producing the separable fastening device of the present invention is considerably less than that of the prior mechanical fastening systems. Also, due to the fact that the separable fastening device of the present invention does not rely on a conventional adhesive bond, the present invention is not subject to a loss of its bonding properties due to contamination as are the prior adhesive-type devices.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
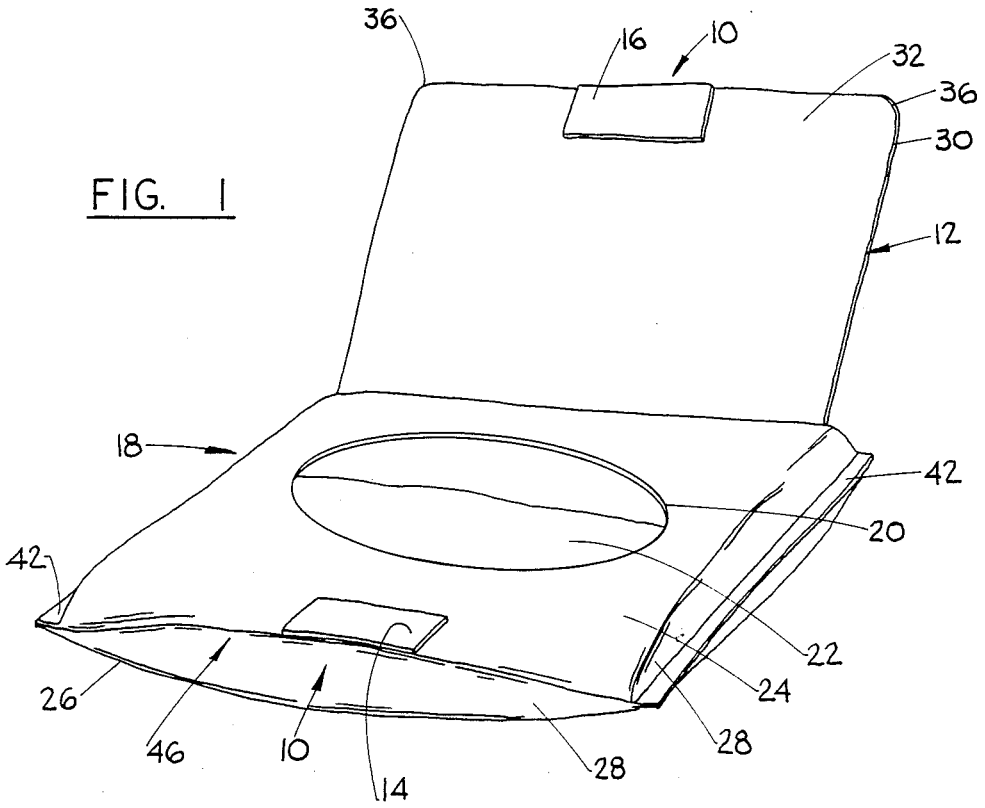
FIG. 1 is a perspective view of the separable fastening device of the present invent on shown affixed to a personal package of facial tissues the flap of which has been opened to permit access to the tissues inside.

As shown in FIG. 1, the separable fastening device of the present invention, generally designated 10, is used as a closure for a personal package of facial tissues 12 (which will hereinafter sometimes be referred to for simplification as the "tissue package 12", or even more simply as the "package 12"). It is to be understood that the embodiment shown in FIG. 1 is a preferred use of the present invention, and the present invention is not limited to use as a closure system for the particular type of package illustrated, or for that matter, as any type of package closure system. The present invention can be used more generally either to releasably fasten several surfaces of a single article together, or to releasably fasten the surfaces of separate articles to each other.

Before examining the elements of the separable fastening device 10 of the present invention in greater detail, a brief explanation of some of the terminology used herein is in order. As used herein, the terms "separable" and "releasable" are intended to be synonymous. The terms as used in the context of a "separable" or "releasable" bond refer to a relationship between two or more articles or surfaces in which the articles or surfaces are generally fastened to each other, yet can be separated with the application of a certain amount of force, and then subsequently refastened at a later time. It is also generally contemplated that as used herein, in order to be "separable" or "releasable", the articles or surfaces must be capable of being repeatedly fastened, separated, and refastened. In addition, in the case of the present invention, it is contemplated that the force utilized to separate the articles or surfaces in issue is an amount which can be applied by hand, and is similar in amount to the force needed to unfasten conventional buttons, snaps, and the like.

In FIG. 1, the personal package of facial tissues 12 is illustrated in open position and the components of the separable fastening device 10 have been separated from one another. In FIG. 1, it is seen that the components of the separable fastening device 10 of the present invention comprise a first fastening element 14 and a second fastening element 16. In the preferred embodiment of the present invention, the first fastening element 14 and the second fastening element 16 are each comprised of a strip of material, which as described more fully herein, are strips of high static vinyl sheet material, acetate, or the like.

It is seen in FIG. 1 that the personal package of facial tissues 12 has a body portion, or body, capable of retaining a plurality of facial tissues, generally designated 18, which has an opening or dispenser 20 for dispensing tissues 22, a first surface (which will hereinafter be referred to as the top, or top surface 24 of the package), a bottom 26, sides 28, and a closure flap, such as flap 30. In the view shown in FIG. 1, only one surface of the flap 30 is visible. This surface will hereinafter sometimes be referred to as the second surface 32 of the package 12, or simply as the second surface, or perhaps more often, as the inside surface of the flap 30. The flap 30 is connected to the body 18 so that the flap can be closed to cover the dispenser 20 in the top surface 24 in such a manner that the inside surface 32 of the flap 30 contacts the top surface 24 of the body 18 of the package 12. The other surface of the flap, the outside surface 34 of the flap 30, is first seen in FIG. 2.

The entire tissue package 12 can be made of any suitable material. However, since the tissue package 12 is intended to be carried by an individual, such as in a woman's handbag, for instance, it is desirable that the package be comprised of a soft, durable, and flexible material. In addition, the material comprising the package should be capable of bending and being subjected to compressive and other forces during normal use without producing a noticeable noise. In the use contemplated by the present invention, the tissue package 12 is made of a polyethylene material. Preferably, the package 12 is comprised of a low density polyethylene film such as that manufactured by Consolidated Thermoplastics Company of Wethersfield, Connecticut, and is known simply as a 2.5 mil. 0.0635 mm.) polyethylene film. In its most preferred form, this film is microembossed with a matte finish to make the package 12 look and feel cloth-like.

Figure 5:
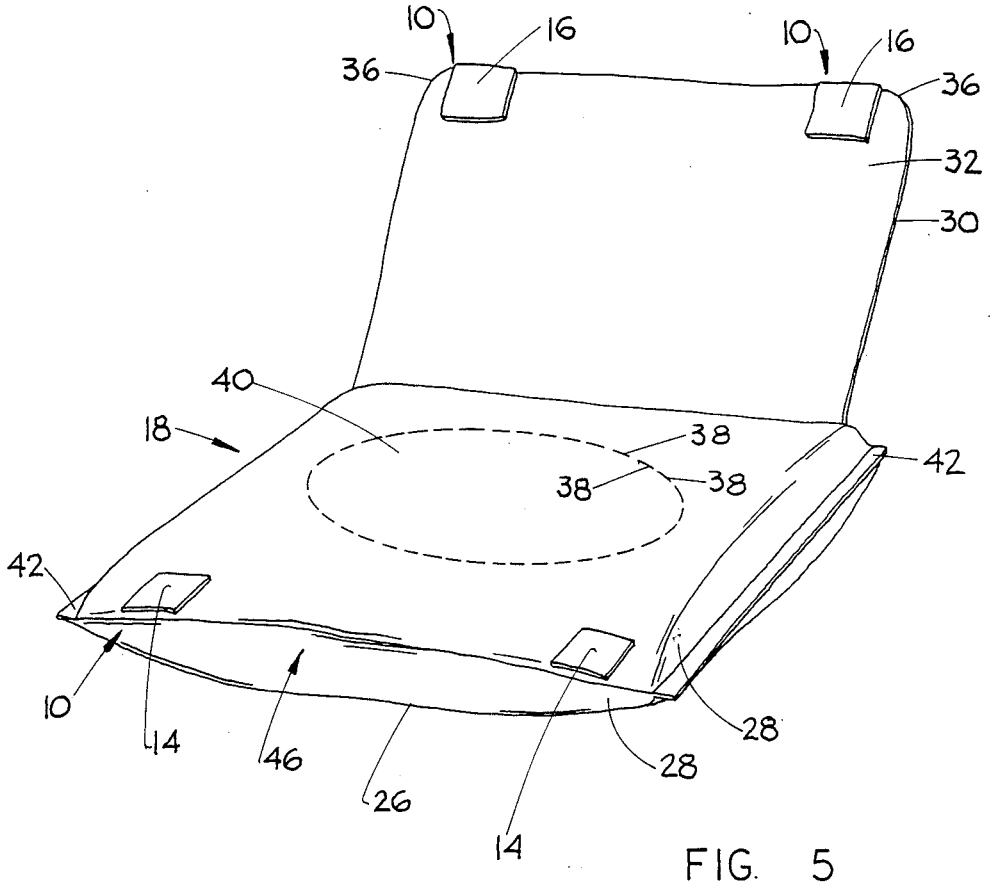
FIG. 5 is a perspective view of an alternative embodiment of the present invention, also shown in use as a closure for a personal package of facial tissues, in which multiple closure components are employed.

The package 12 illustrated in the drawings is made by taking a single sheet of low density polyethylene film and die cutting the sheet into a generally rectangular piece. At the same time the sheet is cut, or in a subsequent operation, the portions of the sheet which will become the corners 36 of the flap 30 are cut into a rounded configuration so the package flap 30 will not present any sharp edges. In addition, and also at either of the foregoing times, an oval-shaped hole can be cut in the piece of film in the appropriate position to form the dispenser 20. In the preferred embodiment of the present invention, a hole is not actually cut entirely through the piece of polyethylene to form the dispenser 20. Instead, and as best illustrated in FIG. 5, perforations 38 are made in such an oval shape around what will become the perimeter of the dispenser 20, to provide the package with a cover 40 over the tissues 22 which can be torn out by the consumer to form the dispenser 20 when the package 12 is first placed in use.

After the above-described cutting operations have been performed on the polyethylene sheet, the first fastening element 14 and the second fastening element 16 can be attached to the polyethylene sheet at the appropriate places in the manner described more fully below. It is also to be understood that, as in the case of most of the manufacturing operations described herein, the order in which the events take place could be varied, and the first fastening element 14 and the second fastening element 16 could be attached as the last step in the process, or at other points in the manufacturing process.

The next step which takes place in the manufacture of the tissue package 12 is a folding and sealing operation. In this operation, in contemplation of the fact that the polyethylene sheet will be folded into approximately three equal portions thereby dividing the longer dimension of the polyethylene sheet into three panels, a plurality of tissues are folded into the desired configuration and placed approximately in the center of the sheet on top of what will become the middle panel of the package. The polyethylene sheet is then folded into three sections. One section will have the hole for the dispenser 20 formed therein, or will be appropriately perforated with an outline of the same, and this section will become the top surface 24 of the package 12. The center section upon which the tissues 22 have been placed, will become the bottom 26 of the package 12. The remaining section should be the one with the rounded corners 36, and will become the package flap 30. Generally, the panel or section which will become the top surface 24 of the package 12 will be folded over the tissues 22 and heat sealed along the lateral side edges 42, and also along the side which has been folded to form the flap 30, the flap side edge 44, to enclose the tissues 22. The flap side edge 44 can be heat sealed either both before and after the flap 30 is folded over the top surface 24 of the package 12, or only after the flap 30 is so folded. The remaining edge of the body 18 cf the package 12, is the edge along which the first fastening element 14 is attached. This remaining edge will be referred to as the closure side edge 46 of the package 12. As seen in the drawings, the closure side edge 46 is generally formed by folding over the panels which form the top surface 24 of the package 12 and the bottom 26 of the package 12. The two panels which are so folded, in the preferred embodiment of the present invention are not creased along the closure side edge 46, nor are they heat sealed, and as a result, the place where these two panels meet provides the closure side edge 46 with a generally rounded profile.

In the preferred embodiment shown in FIG. 1, the first fastening element 14 is attached to the first surface, the top surface 24 of the package 12, and the second fastening element 16 is attached the second surface, the inside surface 32 of the flap 30. It should be understood, however, that even though one of the surfaces of the package has been referred to as the first surface and the other surface has been referred to as the second surface, and a similar designation has been applied to the fastening elements, the separable fastening device 10 of the present invention will work equally well if the positions of the fastening elements 14 and 16 were reversed such that the second fastening element 16 is attached to the first surface 24, and the first fastening element 14 is attached to the second surface 32. Therefore, it should be understood that the names given to the first and second fastening elements 14 and 16, respectively, are for convenience of reference only, and that the first and second fastening elements 14 and 16 may be attached to either the first surface 24 or the second surface 32, provided one fastening element is attached to each surface.

Figure 2:
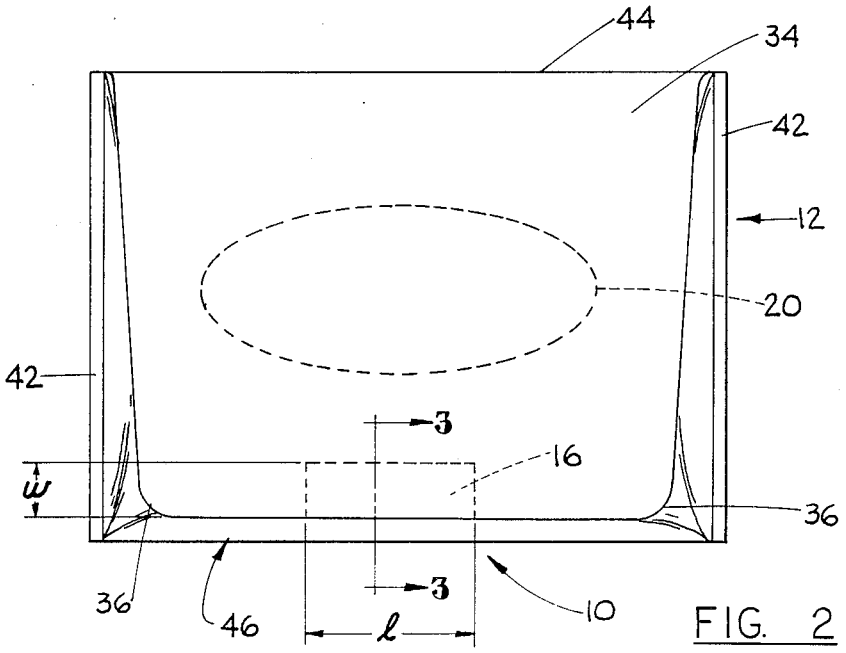
FIG. 2 is a plan view of the personal package of facial tissues of FIG. 1 which is shown with the flap of the package in a closed position.
Figure 3:
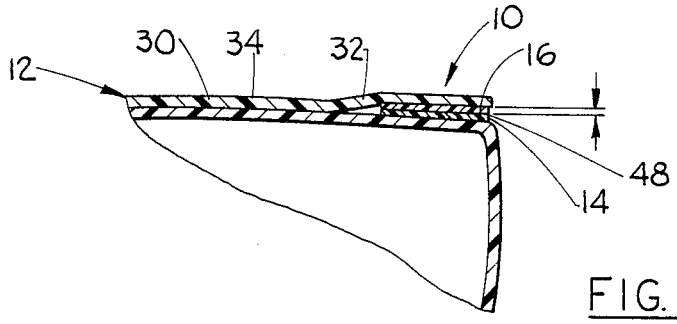
FIG. 3 is a fragmentary sectional view taken along section line 3—3 of FIG. 2 which shows the separable fastening device of the present invention in a closed position.
Figure 4:
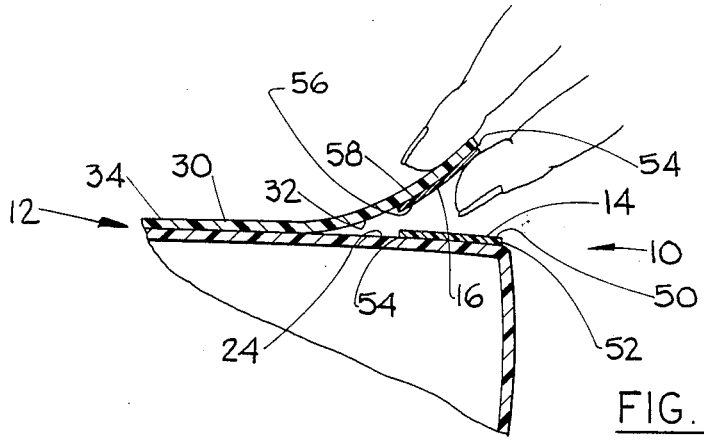
FIG. 4 is a fragmentary sectional view similar to FIG. 3 which illustrates the manner in which the separable fastening device of the present invention is separated to open the package of facial tissues.

FIG. 2 illustrates the package of facial tissues 12 which embodies the separable fastening device 10 of the present invention as it appears from above with the flap 30 closed. FIG. 3 is a fragmentary sectional view of the separable fastening device 10 of the present invention which shows the first fastening element 14 in contact with the second fastening element 16 to form a releasable bond between the surfaces of the two fastening elements at 48. FIG. 4 is a fragmentary sectional view similar to FIG. 3 which illustrates the manner in which the separable fastening device 10 of the present invention is separated to open the package of facial tissues 12. As best seen in FIG. 4, the first fastening element 14 has a first front side 50 and a first back side 52. As further illustrated in FIG. 4, the first back side 52 of the first fastening element 14 faces and is attached by attachment means 54 to the top surface 24 of the package 12. Also as seen in FIG. 4, the second fastening element 16 has a second front side 56 and a second back side 58. The second fastening element 16 also faces and is attached along its back side, second back side 58, by attachment means 54 to a second surface, which in this case is the inside surface 32 of the flap 30 of the tissue package 12.

It is preferred that the first and second fastening elements 14 and 16 be affixed to the respective surfaces 24 and 32 in such a manner that the first fastening element 14 and the second fastening element 16 are positioned directly on top of one another with the first front side 50 of the first fastening element 14 placed against the second front side 56 of the second fastening element 16 when the surfaces 24 and 32 are placed against each other to close the package 12. It has been found that in order to create the most effective bond between the first fastening element 14 and the second fastening element 16, it is desirable that the first front side 50 and the second front side 56 of the first and second fastening elements 14 and 16, respectively, be as free from unevenness and irregularities as possible. It is believed that this will maximize the areas of the two fastening elements which are in contact when the first and second fastening elements 14 and 16 are placed in a face-to-face relationship. Likewise, it is preferable that the surfaces to which the two fastening elements are attached, the first and second surfaces 24 and 32, respectively, should also be as free from unevenness and irregularities as possible, since the surface characteristics of the first and second surfaces 24 and 32 will affect the surface characteristics of the fastening elements 14 and 16 attached to these surfaces.

FIG. 5 illustrates an alternative embodiment of the separable fastening device 10 of the present invention, which utilizes a plurality of components, or multiple first and second fastening elements 14 and 16. In the embodiment shown in FIG. 5, the multiple first and second fastening elements, in this case, two such sets of fastening elements, are employed such that one of the first fastening elements 14 is at each of two corners of the package 12 and their mating components, second fastening elements 16, are located at opposing positions on the inside surface 32 of the package flap 30.

The first and second fastening elements 14 and 16, can be affixed to the respective surfaces of the package 12 by any convenient attachment means 54. The particular attachment means 54 will, of course, depend upon the material out of which the package 12 is made, as well as the material comprising the fastening elements. In the case of the embodiment illustrated in FIG. 3, as will be subsequently discussed, the package 12 is made of polyethylene and the fastening elements are made of high static vinyl material. When the package 12 and the fastening elements 14 and 16 comprise these materials, the preferred attachment means 54 is an adhesive, and most preferably, is a double-sided adhesive tape such as one variation of the same that is manufactured under the trademark "3-M SCOTCH" tape by the Minnesota Mining and Manufacturing Company of St. Paul, Minn. Most preferably, an adhesive backing will be preapplied to the pieces of static vinyl material used to form the first and second fastening elements 14 and 16 so the first and second fastening elements 14 and 16 can be secured directly to the package 12 without laying or applying separate lines or beads of glue to either the package 12 or to the first and second fastening elements 14 and 16. Preferably, such an adhesive backing is applied to an enlarged sheet of high static vinyl material, which enlarged sheet with the backing applied is then cut into individual strips to form the first and second fastening elements 14 and 16 which will be attached to the materials or surfaces which are to be fastened. The first fastening element 14 is then attached to the first article or surface by simply pressing the first fastening element 14 on the first article or first surface 24, and the second fastening element 16 is attached in a similar manner by pressing the second fastening element 16 on the second article or the second surface 32. It should be noted that in this case, no disadvantage is created by using an adhesive to affix the fastening elements 14 and 16 to the package surfaces 24 and 32. The adhesive in this case is not used to form the separable bond between the two fastening elements, but to attach the fastening elements to the top surface 24 of the package 12 and the flap 30. The adhesive used as the attachment means 54 as a result is not exposed, and is therefore not subject to contamination and loss of adhesiveness.

In the preferred embodiment of the present invention, the shape and dimensions of the first fastening element 14 and the second fastening element 16 are approximately the same. It is desirable that the first and second fastening elements 14 and 16 be as similar as possible in these characteristics to make maximum use of the surface contact between the two fastening elements since the attractive forces between the two fastening elements, when comprised of the preferred material for use in the fastening device 10 of the present invention, is dependent upon the surface contact between the components of the fastening device. Preferably, the first and second fastening elements 14 and 16 will be generally rectangular. The dimensions of the first and second fastening elements 14 and 16 are best shown in FIGS. 2 and 3, and are designated as "l", "w", and "t". The dimension which will be referred to as the length of each fastening element ("l") is that dimension which in the embodiment shown in the drawings, runs parallel to the edge of the package 12 along which the first fastening element 14 is affixed (i.e., along the closure side edge 46). The dimension which will be referred to the width of the fastening elements ("w"), is that dimension which is perpendicular to the closure side edge 46 of the package 12. In the preferred embodiment of the present invention, the dimensions of the first and second fastening elements will be such that sufficient attractive forces (which will be hereinafter described) are present between the first and second fastening elements 14 and 16 so they will remain in contact with each other under normal conditions, yet will be easily opened by hand when it is desired to separate the two materials Dr surfaces. The length of the strips which comprise each of the fastening elements ("l") is preferably between 1.0 inch (2.54 cm.) and 3.0 inches (7.62 cm.). The width of the strips which comprise each of the fastening elements ("w") is preferably between 0.5 inch (1.27 cm.) and 1.0 inch (2.54 cm.). The thickness of the strips which comprise each of the fastening elements ("t" in FIG. 3), in the preferred embodiment of the invention, is 10 mils (0.254 mm.).

In the present invention, both the first fastening element 14 and second fastening element 16 are comprised of high static vinyl, acetate, or the like. As noted above, the first fastening element 14 and the second fastening element 16, preferably comprise strips of high static vinyl, acetate, or the like sheet material having the above dimensions. As used herein, the term "strip" refers to a relatively thin and narrow piece of a sheet of material. A suitable high static vinyl material for use in the separable fastening device 10 of the present invention is manufactured by Kohkoku USA, Inc. of Everett, Wash., and is known as "Hi-Tack" vinyl. It has been found that when two strips of high static vinyl, acetate, or the like material are placed against each other in a face-to-face relationship, an attractive force is created between the two strips which is sufficient to allow the same to be used as the components of a separable fastener system. It is believed that the attractive force between the two strips may be an electrostatic force. The properties which create these electrostatic forces are generally imparted to the high static vinyl material during the manufacturing of the material. It is believed that the magnitude of the electrical properties of a particular strip of high static vinyl material may be dependent in part on the amount of plasticizer which is added to the plastic composition during the process of manufacturing the high static vinyl material. The relationship between the amount of plasticizer and the electrical properties of the polyvinyl chloride composition is explored more fully in Vol. 21, *Journal of Applied Physics,* Mechanical and Electrical Properties of Plasticized Vinyl Chloride Compositions (New York, N.Y., 1950), pages 607–614, which is incorporated by reference herein.

The present invention also concerns a method of making a separable fastening device for releasably fastening a first surface to a second surface, which comprises attaching a first fastening element 14 of high static vinyl material to a first article or a first surface of an article, such as the top surface 24 of tissue package 12, and attaching a second fastening element 16 of high static vinyl material to a second article or second surface, such as the inside surface 32 of the flap 30 of tissue package 12, so that when the first fastening element 14 and the second fastening element 16 are placed against each other in a face-to-face relationship, the attractive forces between the first fastening element 14 and the second fastening element 16 form a separable bond between the surfaces, or between the articles to which the fastening elements are attached.

This invention also concerns a method of releasably fastening several articles or releasably fastening several surfaces, which will generally be opposing surfaces, of a single article. The method of the present invention comprises providing joined to a first article or surface, such as top surface 24 of package 12, a first fastening element 14 of high static vinyl material and providing joined to a second article or surface, such as inside surface 32 of flap 30, a second fastening element 16 of high static vinyl material and placing the first fastening element 14 and the second fastening element 16 against each other in a face-to-face relationship, so that the attractive forces present between the first fastening element 14 and the second fastening element 16 form a separable bond between the articles or surfaces. In the preferred embodiment of the present invention, the separable fastening device 10 is used for releasably fastening a flap 30 on a personal package of facial tissues 12 to the body of the package of tissues. In this preferred use, the first fastening element 14 of high static vinyl material is attached to the body 18 of the package of tissues 12, and preferably to the top surface 24 of the same, and the second fastening element 16 of high static vinyl material is attached to the flap 30, preferably the inside surface 32 of the flap 30 of the package of tissues 12, so that when the flap 30 is closed, the first and second fastening elements 14 and 16 of high static vinyl material are placed against each other in a face-to-face relationship to form a separable bond between the package flap 30 and the body 18 of the package 12.

The manner in which the separable fastening device 10 operates and in which the method of releasably fastening articles is carried out is seen in FIGS. 3 and 4. In FIG. 3, the separable fastening device 10 of the present invention is shown as it exists under normal conditions with the two strips of high static vinyl material which comprise first fastening element 14 and second fastening element 16, in a face-to-face relationship to fasten the inside surface 32 of the package flap 30 to the top surface 24 of the package 12. FIG. 4 illustrates the manner in which the separable fastening device 10 of the present invention is separated to unfasten the two surfaces. As seen in FIG. 4, this unfastening is accomplished by applying a peeling force by hand to one of the strips of high static vinyl sheet material which comprises the separable fastening system, much in the same manner as that used to separate conventional mechanical fasteners. However, in the case of the present invention, virtually no audible sound is created when the two fastening elements are peeled apart. The device is refastened by simply placing the two fastening elements back together in a face-to-face relationship.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A separable fastening device for releasably fastening a closure flap of a package to the body of the package, said separable fastening device comprising:

a first fastening element of high static vinyl material attached to the body of the package; and a second fastening element of high static vinyl material attached to an opposing surface on the closure flap of said package so that when said first fastening element and said second fastening element are placed against each other in a face-to-face relationship, the attractive forces present between said first fastening element and second fastening element form a separable bond between the closure flap of the package and the body of the package.

2. A separable fastening device for fastening a closure flap on a personal package of facial tissues to the body of said package of tissues, said separable fastening device comprising:

a first fastening element of high static vinyl material attached to the body of said package of tissues; and a second fastening element of high static vinyl material attached to the closure flap of said package of tissues so that when the first fastening element and the second fastening element are placed against each other in a face-to-face relationship, the attractive forces present between said first fastening element and second fastening element form a separable bond between the closure flap of the package of tissues and the body of the package of tissues.

3. A personal package of facial tissues comprising:

a body capable of retaining a plurality of facial tissues, said body portion having a top surface and a dispenser in said top surface for dispensing tissues;

a closure flap having an inside surface and an outside surface, said closure flap being connected to said body portion so that said closure flap can be closed to cover the dispenser in said top surface in such a manner that the inside surface of the closure flap contacts said top surface of said body portion;

a first fastening element of high static vinyl material attached to said top surface of said body portion of the package of facial tissues; and a second fastening element of high static vinyl material attached to said inside surface of said closure flap so that when said closure flap is closed, said second fastening element is placed in a face-to-face relationship with said first fastening element, and the attractive forces present between said first fastening element and said second fastening element form a separable bond between said closure flap and said body of said package of facial tissues.

* * * * *

UNITED STATES PATENT AND TRADEMARK OFFICE

CERTIFICATE OF CORRECTION

PATENT NO. : 4,979,613

DATED : December 25, 1990

INVENTOR(S) : Carol A. McLaughlin et al.

It is certified that error appears in the above-identified patent and that said Letters Patent is hereby corrected as shown below:

IN THE FIGURES:

Figure 3, insert --t-- to the right of the vertically oriented lead arrows.

Figure 5, add reference numeral --10-- and an appropriate lead line at the lower right hand corner of the package.

Column 3, line 57 delete "invent on" and insert therefor --invention--.

Column 6, line 13 delete "cf" and insert therefor --of--.

Column 8, line 47 delete "Dr" and insert therefor --or--.

Column 6, line 29 after "attached" insert --to--.

Signed and Sealed this

Sixteenth Day of March, 1993

*Attest:*

STEPHEN G. KUNIN

*Attesting Officer*

*Acting Commissioner of Patents and Trademarks*